US005470254A

United States Patent [19]

Kaney

[11] Patent Number: 5,470,254

[45] Date of Patent: Nov. 28, 1995

[54] TERMINAL BLOCK FOR SMALL APPLIANCES

[75] Inventor: Howard W. Kaney, West Bend, Wis.

[73] Assignee: The West Bend Company, West Bend, Wis.

[21] Appl. No.: 342,919

[22] Filed: Nov. 21, 1994

Related U.S. Application Data

[62] Division of Ser. No. 138,086, Oct. 20, 1993, Pat. No. 5,425,655.

[51] Int. Cl.[6] ..... H01R 13/50; H01R 9/12

[52] U.S. Cl. ..... 439/439; 439/723

[58] Field of Search ..... 439/723, 439, 439/441, 437, 438

[56] References Cited

U.S. PATENT DOCUMENTS

| | | | |
|---|---|---|---|
| Re. 31,142 | 2/1983 | Simmons | 339/74 R |
| 2,503,559 | 4/1950 | Miloche | 173/363 |
| 2,720,634 | 10/1955 | Hart | 339/95 |
| 2,834,951 | 5/1958 | Aquillon et al. | 339/217 |
| 3,064,227 | 11/1962 | Sams et al. | 339/95 |
| 3,079,406 | 1/1962 | Slater | 439/439 |
| 3,099,505 | 7/1963 | Schwartz | 439/439 X |
| 3,138,421 | 6/1964 | Locher et al. | 339/95 |
| 3,252,124 | 5/1966 | Hansen | 339/47 |
| 3,496,521 | 2/1970 | Hohorst | 339/95 |
| 3,534,325 | 10/1970 | Julien-Davin | 339/198 |
| 3,596,229 | 7/1971 | Hohorst | 339/61 R |
| 3,697,926 | 10/1972 | Krafthefer | 339/17 L |
| 3,945,711 | 3/1976 | Hohorst et al. | 339/95 D |
| 4,036,545 | 7/1977 | Mysiak et al. | 339/95 D |
| 4,037,898 | 7/1977 | Guyette | 337/17 C |
| 4,084,876 | 4/1978 | Dinger | 339/95 D |
| 4,114,975 | 9/1978 | Weidler | 339/176 M |
| 4,171,861 | 10/1979 | Hohorst | 339/198 G |
| 4,284,395 | 4/1980 | Blaha | 439/438 |
| 4,367,006 | 1/1983 | Rehbogen, Jr. | 339/176 MF |
| 4,420,215 | 12/1983 | Tengler | 439/723 |
| 4,585,902 | 4/1986 | Munroe | 174/87 |
| 4,673,232 | 6/1987 | Kubota et al. | 439/441 |
| 4,738,186 | 7/1988 | Barriuso et al. | 439/723 |
| 4,767,340 | 8/1988 | Hohorst | 439/729 |
| 4,768,981 | 9/1988 | Hohorst | 439/835 |
| 4,891,017 | 1/1990 | Kuhn et al. | 439/380 |
| 4,971,567 | 11/1990 | Mizuno et al. | 439/98 |
| 4,973,263 | 11/1990 | Nielsen | 439/438 |
| 4,978,315 | 12/1990 | Edgley | 439/441 |
| 5,110,305 | 5/1992 | Edgley | 439/441 |
| 5,116,238 | 5/1992 | Holloman | 439/441 |
| 5,126,608 | 6/1992 | Sogabe et al. | 310/71 |
| 5,127,846 | 7/1992 | Köllmann | 439/441 |
| 5,145,411 | 9/1992 | Pastal et al. | 439/598 |
| 5,158,468 | 10/1992 | Curtis et al. | 439/76 |
| 5,158,475 | 10/1992 | Tyler et al. | 439/439 |
| 5,205,757 | 4/1993 | Hertelendy | 439/441 |

FOREIGN PATENT DOCUMENTS

| | | | |
|---|---|---|---|
| 0046124 | 8/1981 | European Pat. Off. . | |
| 246199 | 11/1987 | European Pat. Off. | 439/439 |
| 0554519A2 | 10/1992 | European Pat. Off. . | |
| 76151 | 7/1953 | Germany | 439/441 |
| 1431416 | 4/1976 | United Kingdom . | |
| 1536189 | 12/1978 | United Kingdom | 439/439 |

*Primary Examiner*—William Briggs
*Attorney, Agent, or Firm*—Jansson & Shupe, Ltd.

[57] ABSTRACT

Disclosed is a terminal block especially suited for rapidly wiring small appliances. The block has an insulating housing holding a plurality of electrically-conductive connectors and in the improvement, at least a first connector is bifurcated to define a pair of jaw-like wire-grasping structures for electrically connecting a pair of wires to one another. The structures are separated by a tongue-like barrier for easy guided insertion of a single wire into each structure. The block is also disclosed in combination with an appliance enclosure having a platform supporting the terminal block. The platform has at least one block retention stud, the terminal block includes at least one surface deformation and the stud and the deformation coactively engage to restrain movement of the block.

15 Claims, 9 Drawing Sheets

FIG. 1
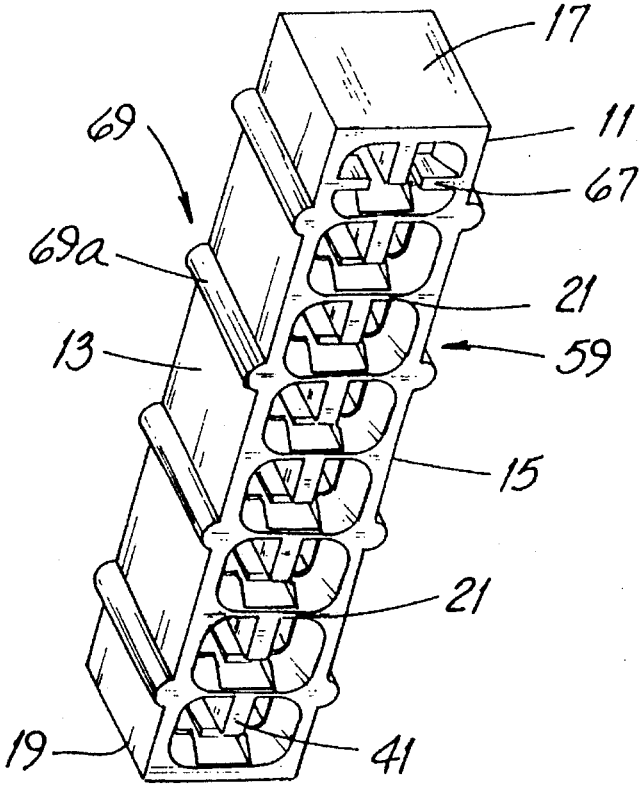
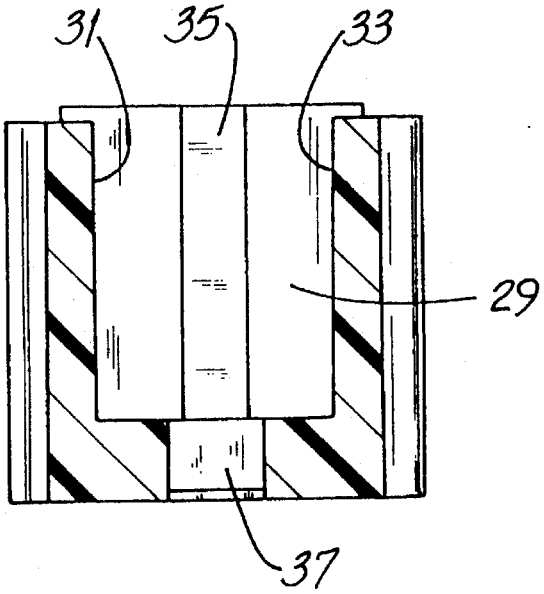
FIG. 5

TERMINAL BLOCK FOR SMALL APPLIANCES

RELATED APPLICATIONS

This application is a division of application Ser. No. 138,086 filed on Oct. 20, 1993, U.S. Pat. No. 5,425,655.

FIELD OF THE INVENTION

The invention relates generally to electricity and, more particularly, to electrical connectors.

BACKGROUND OF THE INVENTION

Electrical equipment, both stationary and portable, almost invariably requires a number of electrical connections. Such connections are between control elements, e.g., switches, printed circuit boards and the like, and wiring used to carry electrical power between the elements themselves and/or between the elements and controlled components such as an electric drive motor.

And, often, the number of connections suggests using a strip-like, multi-connection device called a terminal block. Such a block "gangs" the connections and provides a more convenient central location for them. An example of a strip-like connector for flat cable is shown in U.S. Pat. No. 4,367,006 (Rehbogen, Jr. et al.) and other examples are shown in the product literature of Wago Corporation.

A common way to effect electrical connections without the use of solder involves wire nuts, compression lugs affixed by screws or other types of threaded devices. Another way to make an electrical connection is to solder a wire to a terminal in the manner depicted in U.S. Pat. No. 2,503,559 (Miloche). Still other types of electrical connectors are of the "push-in" type and involve spring-like devices to contact wire inserted into them. Examples of connectors of this latter type are shown in U.S. Pat. Nos. 4,036,545 (Mysiak et al.) and 4,673,232 (Kubota et al.) and in the aforementioned Wago literature.

While prior art connectors and terminal blocks have been generally satisfactory for their intended purposes, they are attended by certain disadvantages. One disadvantage arises from differences in the demands of the application.

Manufacturers of capital-goods equipment built in relatively small quantities (material handling cranes, for example) and used for many hours each day can usually afford the labor and material costs which attend the use of threaded connectors. Such costs are a relatively small part of the overall machine cost. And, often, the higher equipment power levels and the sometimes-abusive use experienced by such equipment dictate larger wire and threaded connectors to help assure long-lived, trouble-free connections.

As a contrasting example, small appliances (especially those intended for the home) are used relatively infrequently and then only for short durations. And their power requirements are modest. Such appliances are typically sold in highly price-competitive markets and a cost reduction of a few cents per appliance is very attractive to the appliance manufacturer.

Although small appliances impose quite different demands upon the machine electrical system and upon the techniques used during initial assembly, designers of connecting devices used therein have not fully appreciated how to best address such demands. For example, threaded and "twist-on" connectors are still find use in such appliances for connecting wires together. Such connectors are "labor-intensive"—the time required to use them in assembling the product is quite significant.

And while terminal blocks are used in small appliances, they are often mounted to the appliance housing using separate fasteners. Such fasteners are commonly installed by hand or with hand tools on an assembly line and the appliance is thereby additionally "burdened" with an incremental labor cost which, in view of the invention, is unnecessary.

Another disadvantage of certain known terminal blocks is that they are devoid of any feature which helps avoid damage to the electrical connector by improperly "tugging" on the wire attached to such connector. U.S. Pat. No. 4,036,545 (Mysiak et al.) is an example of such a terminal block. After the wire is connected, tugging it toward one or the other of the terminal wall portions might impair the integrity of such terminal.

OBJECTS OF THE INVENTION

It is an object of the invention to provide an improved terminal block overcoming some of the problems and shortcomings of the prior art.

Another object of the invention is to provide an improved terminal block which is highly suited for use with small appliances.

Another object of the invention is to provide an improved terminal block which helps reduce the cost of appliance assembly.

Another object of the invention is to provide an improved terminal block permitting very rapid connection of wire.

Still another object of the invention is to provide an improved terminal block which avoids use of threaded fasteners and solder, either for wire attachment or for block mounting.

Another object of the invention is to provide an improved terminal block having a visual guide feature used during wire attachment.

Yet another object of the invention is to provide an improved terminal block having a structural guide feature used during wire attachment.

Another object of the invention is to provide an improved terminal block which helps avoid post-connection damage to the connector. How these and other objects are accomplished will become more apparent from the following descriptions and from the drawing.

SUMMARY OF THE INVENTION

The invention involves a new terminal block specially configured to permit easy, quick, secure wiring of small electrical appliances. In general, the block has an insulating housing holding a plurality of electrically-conductive connectors. Each connector is received in a separate one of a plurality of apertures formed in the block housing. Aspects of the housing are first summarized and this is followed by a brief discussion of the conductive connector.

Each aperture is bounded in part by a first roof-like surface and a second floor-like surface which are generally parallel to one another. Each aperture has a groove along its second surface and such groove terminates in a frontal, ramp-like retention surface. The groove facilitates insertion of the connector and its projecting retention tab (described below) which slides along the groove.

Wire-grasping structures of the connector are separated by a rib-like barrier. This barrier or tongue coacts with other portions of the block housing, e.g., the flared mouth portion of an aperture, to form a visual and structural "guide" facilitating quick insertion of a wire into each wire-grasping structure by an appliance assembler. In a highly preferred embodiment, the tongue is interposed between the wire-grasping structures so that a wire grasped by a structure is restrained from lateral wire-detaching movement.

The tongue has a first edge and there is a space between such edge and the second surface. The connector is received in and occupies a portion of such space. Preferably, the tongue does not extend the full depth (front-to-rear) of the aperture. Rather, the rear or second edge of the tongue is forward of and spaced from the rear opening of the aperture. This feature leaves a space for the non-bifurcated finger support portions of the connector.

In a highly preferred embodiment, at least one aperture has a stop member (and preferably two such members) limiting movement of a connector in such aperture. The stop member projects slightly into the aperture and acts as a limit to prevent movement of the connector past the member. In other words, the stop member "locates" the connector at its fully seated position when the connector is inserted into the aperture.

A connector will now be described. At least one of the connectors, e.g., a first connector, is fork-like (bifurcated) to define a pair of jaw-like wire-grasping structures for electrically connecting two wires together. The structures are separated by the aforementioned tongue which, with portions of the block housing, form the guide mentioned above. Interposition of the tongue between the wire-grasping structures restrains a wire from lateral wire-detaching movement.

More specifically, the first connector includes a rear panel and in one specific embodiment, such panel has a hole for engaging a block locating pin when the block is mounted. First and second generally flat arms extend from the panel and each arm has a finger support portion from which a pair of spaced fingers extend. Each finger of the first arm coacts with a finger of the second arm to form a wire-grasping structure.

The retention tab extends from the finger support portion of the second arm and, more specifically, from between the fingers of such arm. When the connector is fully "seated" in the housing (i.e., against a stop member discussed above), the tab bears against the retention surface for retaining the connector in the housing.

In another aspect of the invention, the terminal block has a feature which helps retain the integrity of the connector if a wire connected thereto is "tugged" or pulled improperly in a particular direction. The block has a rib projecting across one of the wire-grasping structures for preventing damage to such structure by such improper wire pulling. In particular, the rib helps keep the wire aligned with the structure and prevent distorting bending of a connector finger. Preferably, all such wire-grasping structures have a rib projecting thereacross for protection.

In yet another aspect of the invention, the terminal block is combined with the appliance enclosure and such combination incorporates unique features for restraining the block against movement, both during and after assembly. More specifically, the block is restrained from movement in any of three axes. Details of the arrangement are discussed below.

The enclosure includes a platform supporting the terminal block and such platform has at least one finger-like block retention stud. The terminal block includes at least one surface deformation, e.g., a ridge or a depression, and the stud and the deformation coactively engage to restrain movement of the block along its first or long axis.

In a more specific embodiment, the terminal block has at least two closely-spaced surface deformations, each embodied as an outwardly-projecting ridge. The stud and the two ridges coactively engage to restrain movement of the block. In another more specific embodiment, the ridges are more widely spaced, the platform has at least two block retention studs and each stud coactively engages a separate ridge to restrain movement of the block.

In another aspect of the combination, the terminal block also has a second, lateral axis. The enclosure includes a wall, the terminal block is "captured" between the wall and the stud for restraining lateral block movement along the second axis.

And that is not all. The enclosure has first and second "shell-like" components attached to one another. The platform is on the first component and the second component has at least one retention tang. When the appliance is assembled and the components attached to one another (or, perhaps, to some intervening device), the terminal block is also captured between the platform and the retention tang. This restrains block movement away from the platform, i.e., in a direction along a third block axis.

After analyzing the descriptions and the drawing, it will be appreciated that the invention addresses several disadvantages of earlier arrangements. For example, in the invention, wires are connected without using solder, wire nuts or other types of fasteners. Similarly, the terminal block is retained in place during assembly wire hookup and is prevented from substantial movement in each of three directions. To put it another way, the invention provides "two axis restraint" of the terminal block during assembly and "three axis restraint" when the appliance is in use.

And the invention is very easy to unwire. The block is removed from the platform, any or all of the connectors are urged out the rear of their respective apertures using a small tool and the connected wire is moved laterally to disengage from the wire-grasping structure of the connector. Other details of the invention are set forth in the detailed description and in the drawing.

BRIEF DESCRIPTION OF THE DRAWING

FIG. 1 is a perspective view of the housing of the new terminal block.

FIG. 5 is a cross-sectional view of the housing of FIG. 2 taken along the viewing plane 5—5 thereof.

DETAILED DESCRIPTION OF PREFERRED EMBODIMENTS

Figure 2:
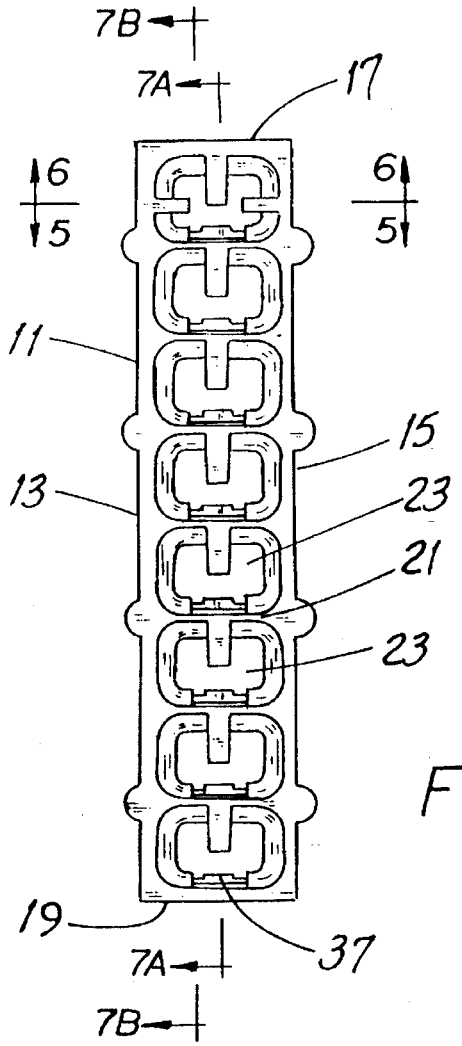
FIG. 2 is a front elevation view of the housing of FIG. 1.

The terminal block 10 of the invention has two components, namely, a housing and a connector fitted into the housing. Such components will be described in that order.

Preliminarily, it is to be appreciated that terms such as "top," "bottom," "rear" and the like relate to the orientation of a component as shown in the drawing and are not necessarily descriptive of a component or of the terminal block 10 as oriented in actual use. Of course, such "actual use" orientation can vary widely.

Referring first to FIGS. 1, 2, 3A and 4, the housing 11 is formed of electrically-insulating material and includes left and right side walls 13 and 15, respectively, and a top wall 17 and bottom wall 19. Such housing 11 also includes several partitions 21 dividing the housing into a number of apertures 23, each of which receives a connector 25 as described below. As is apparent from the drawing, each aperture 23 is defined by the side walls 13, 15 and depending upon the particular aperture 23 under consideration, by a partition 21 and the top wall 17, by two partitions 21 or by a partition 21 and the bottom wall 19.

Figure 6:
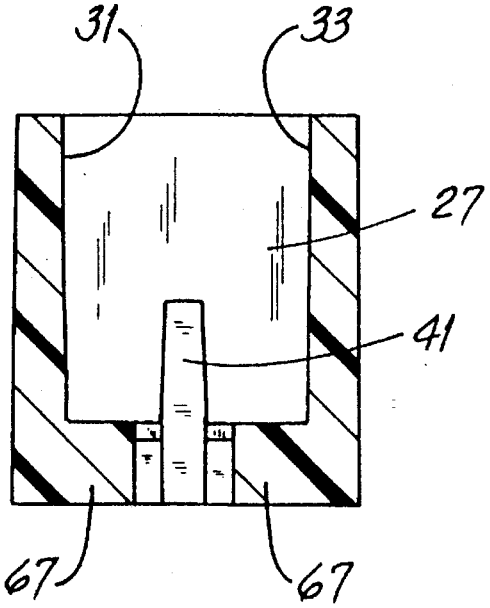
FIG. 6 is a cross-sectional view of the housing of FIG. 2 taken along the viewing plane 6—6 thereof.

As shown in FIGS. 5 and 6, each aperture 23 includes a first, roof-like upper surface 27, a second, floor-like lower surface 29 and a pair of lateral surfaces 31, 33. The surfaces 27 and 29, like the lateral surfaces 31, 33, are generally parallel to one another. While the upper surface 27 and the lateral surfaces 31, 33 are generally smooth, the lower surface 29 has a gently-sloping groove 35 formed in it. Such groove 35 extends the length of the aperture 23 and at the front of such aperture 23, terminates in a downwardly-sloping, ramp-like retention surface 37.

As will be more apparent after appreciating the description of a connector 25, such connector 25 has a retention tab 39 which slides along the groove 35 when the connector 25 is inserted and which bears against the retention surface 37 when the connector 25 is seated. Engagement of the tab 39 with the surface 37 helps retain the connector 25 in the housing 11 and properly positioned in the connector aperture 23.

Extending downwardly from the upper surface 27 is a rib-like barrier or tongue 41. As described below, the tongue 41 electrically isolates the connector wire-grasping structures 43 from one another and also helps define a visual and structural guide 45 to aid wire insertion.

Figure 7B:
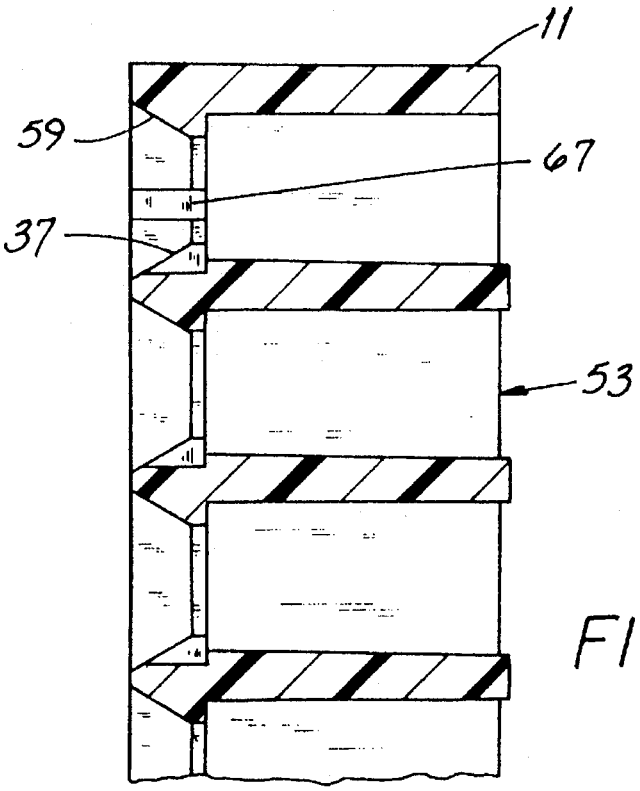
FIG. 7B is a cross-sectional view of the housing of FIG. 2 taken along the viewing plane 7B—7B thereof and with part broken away.
Figure 7A:
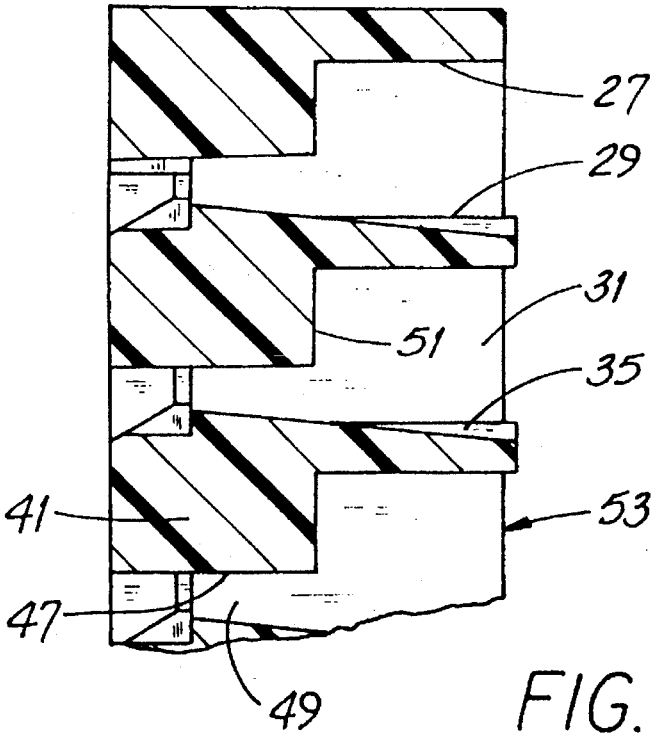
FIG. 7A is a cross-sectional view of the housing of FIG. 2 taken along the viewing plane 7A—7A thereof and with part broken away.

Referring to FIG. 7, in a highly preferred embodiment, the tongue 41 does not extend the entire distance between the upper and lower surfaces 27, 29. Rather, the tongue 41 has a first, lower edge 47 and there is a space 49 between such edge 47 and the second surface 29. A connector 25 is received in and occupies a portion of that space 49. And, preferably, the tongue 41 does not extend the full depth (front-to-rear) of the aperture 23. Rather, the rear or second edge 51 of the tongue 41 is forward of and spaced from the rear opening 53 of the aperture 23. This feature leaves a space to house the non-bifurcated finger support portions 55, 57 of the connector 25. And the rear edge 51 limits travel of the connector 25 so that the connector rear panel 52 is substantially flush with the aperture rear opening 53.

Figure 3B:
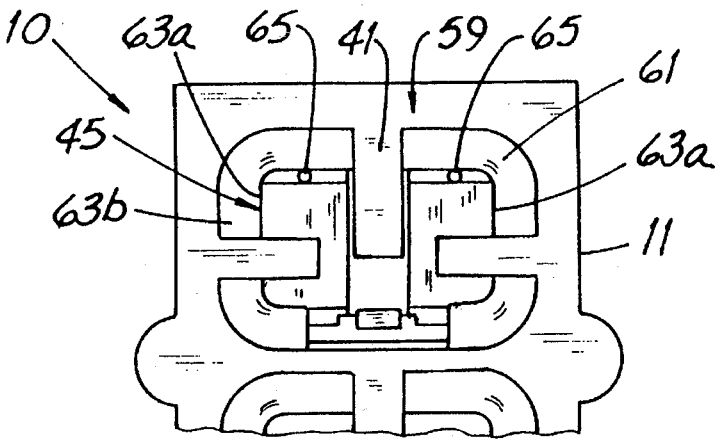
FIG. 3B is a front elevation view of a portion of the terminal block housing, a connector therewithin and wires attached to the connector. Parts are broken away.
Figure 3C:
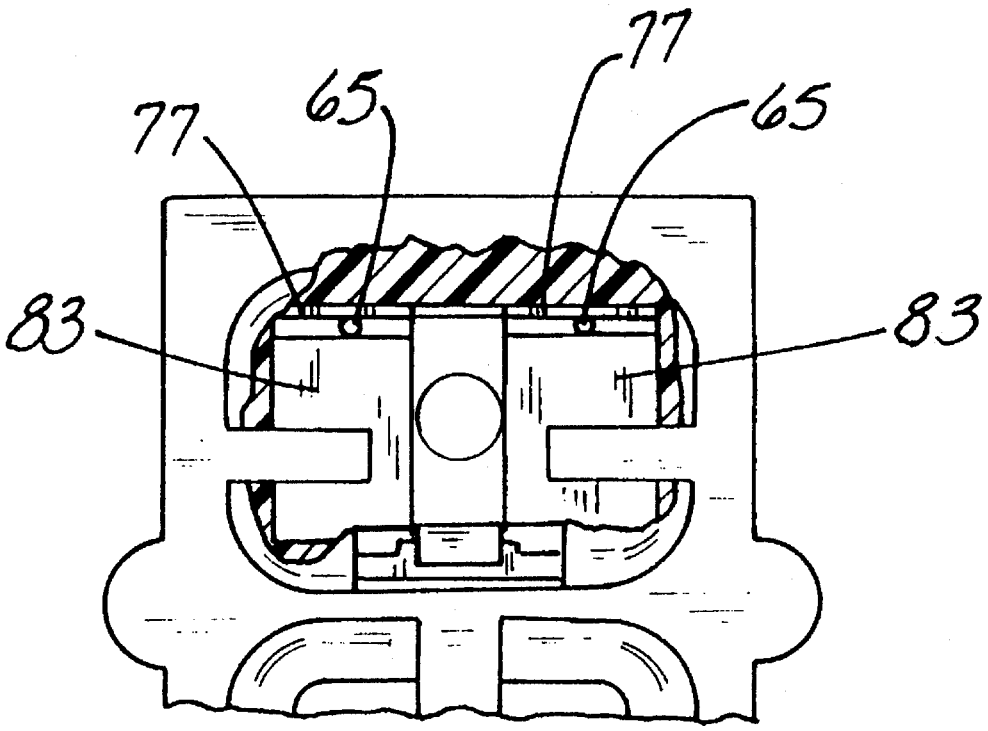
FIG. 3C is a front elevation view of a portion of the terminal block housing, a connector therewithin and wires attached to the connector. Parts are broken away including to show the connector lateral edges and the fingers of the connector upper arm.
Figure 3A:
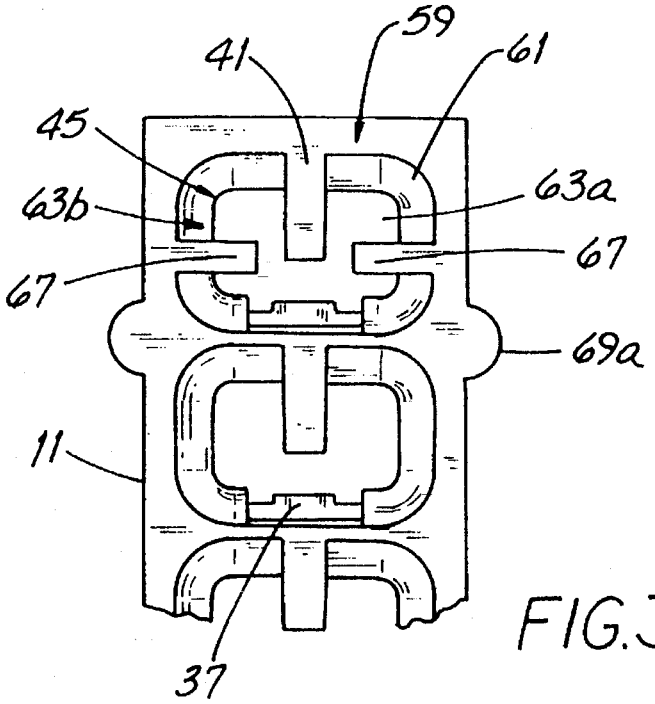
FIG. 3A is a front elevation view of a portion of the terminal block housing. Parts are broken away.

As best seen in FIGS. 1 and 3A, each aperture 23 includes a flared mouth portion 59, the chamfer-like surface 61 of which extends substantially entirely around the front perimeter of the aperture 23. An inspection of FIG. 3A shows how the flared portion 59 and the tongue 41 define a pair of side-by-side "target areas" or visual guides **63*a* into which an assembler thrusts a wire 65 for attachment to the connector 25 described below. And such guide 63*a* is not only visual; the mouth portion 59 and the tongue 41 comprise a structural guide 63*b* for the wire 65** being inserted.

Referring again to FIGS. 2, 3A, 3B and 5, the new block 10 also has a rib 67 projecting laterally across each wire-grasping structure 43. The arrangement and purpose of such ribs 67 is described below immediately following the description of the connector fingers.

Referring also to FIGS. 1, 8, 9 and 10, the housing 11 also includes at least one (and preferably several) surface deformations 69 which are used as described below to help retain the block 10 in an appliance enclosure. In a highly preferred embodiment, such deformations 69 are embodied as outwardly-projecting, half-cylinder ridges **69*a* aligned with alternating partitions 21. However, after appreciating the portion of the specification below relating to the terminal block 10 in combination with an appliance enclosure, one of ordinary skill will understand how other types and arrangements of deformations 69, e.g., single groove-like depressions 69*b* or other ridge spacings, can be used to help retain the block 10** in position in an appliance.

Figure 11:
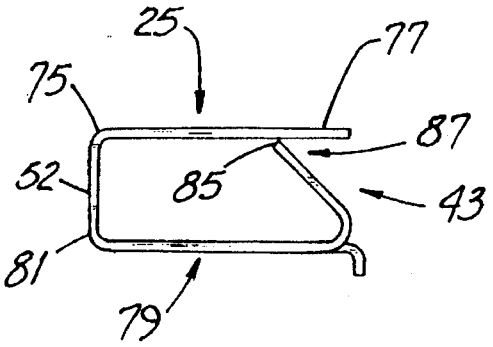
FIG. 11 is a side elevation view of the connector of FIG. 4.
Figure 12:
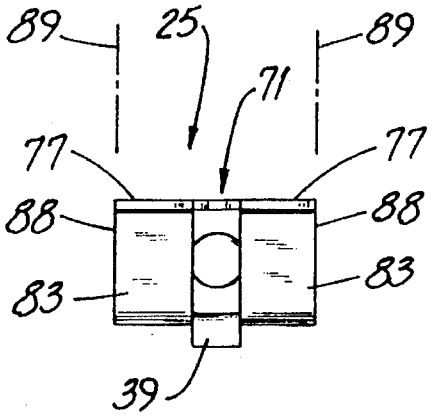
FIG. 12 is a front elevation view of the connector of FIGS. 4 and 11.
Figure 4:
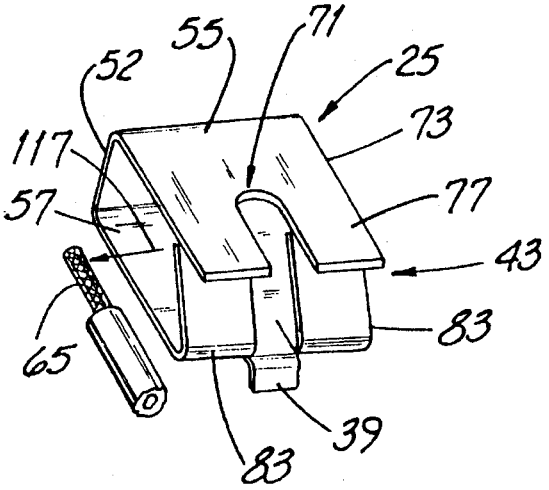
FIG. 4 is a perspective view of a connector of the new terminal block shown in conjunction with a wire. Parts are broken away.

Referring now to FIGS. 4, 11 and 12, a connector 25 will now be described. While a terminal block 10 could be used with but a single connector 25 to electrically attach two wires 65 together, the preferred block 10 has a connector 25 in all or almost all of the apertures 23.

The one-piece, electrically-conductive connector 25 is made of "springy" ribbon-like material such as cartridge brass. Such connector 25 is bifurcated to define a pair of jaw-like wire-grasping structures 43 for electrically connecting two wires 65 together, one inserted into each structure 43. When the connector 25 is in the housing 11, the structures 43 are separated by the aforementioned tongue 41 which dovetails into the connector notch 71.

The connector 25 includes a generally flat rear panel 52 and a first, generally flat upper arm 73 extending forward from the upper edge 75 of the panel 52. The arm 73 has a finger support portion 55 and a pair of coplanar fingers 77 extend from such portion 55. When the connector 25 is installed in the housing 11, the arm 73 (including its portion 55 and its fingers 77) are substantially in contact with the upper surface 27 of the aperture 23.

The connector 25 also has a second arm 79 extending forward from the lower edge 81 of the panel 52. Like the arm 73, the arm 79 has a finger support portion 57 from which a pair of spaced fingers 83 extend. The somewhat "J-shaped" fingers 83 are bent upward and rearward and the end 85 of each finger 83 contacts the under surface of one of the fingers 77 to form a wire-grasping structure 43.

Figure 13:
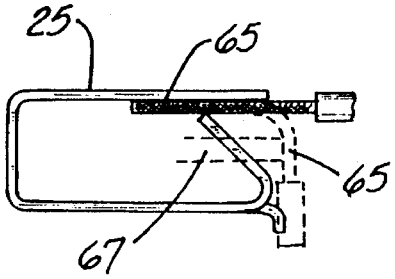
FIG. 13 is a side elevation view, like that of FIG. 11, of the connector in conjunction with a wire and a housing rib. The rib and a position of the wire are shown in dashed outline.

From an inspection of FIGS. 4, 11 and 13, it will be appreciated that as the end of a wire 65 is inserted (from right to left) between an end 85 and a finger 77, such wire 65 is also guided by a finger 83. Once inserted, the end 85 "grips" the wire 65 and makes it difficult to withdraw such wire 65. A secure connector-wire electrical contact is thereby established.

As mentioned above, the block 10 also has a rib 67 projecting across each wire-grasping structure 43. Considering FIG. 13, the rib 67 helps keep the wire 65 aligned in the V-shaped slot 87. In turn, this helps prevents such wire 65 from distorting (and possibly permanently deforming) the J-shaped finger 83 in the event such wire 65 is tugged to an angular position as shown in dashed outline. Some apertures 23 are illustrated devoid of ribs 67 and the block 10 is nevertheless highly useful. However, in a highly preferred embodiment, each aperture 23 has a pair of oppositely-extending ribs 67 projecting across it.

Considering FIGS. 4, 5 and 12, (and as mentioned briefly above) the connector 25 has a retention tab 39 which extends from the finger support portion 57 of the second arm 79 and, more specifically, from between the fingers 83 of such arm 79. When the connector 25 is fully seated in the housing 11, the tab 39 overlays and bears against the retention surface 37 for retaining the connector 25 in the housing 11.

As best seen in FIG. 12, each of the lateral edges 88 of the connector 25 defines a plane 89 and the planes 89 are generally parallel to one another. Further, when the connector 25 is in the housing 11, the planes 89 are generally parallel to the lateral surfaces 31, 33 of the aperture 23. And each such lateral edge 88 is substantially in contact with its corresponding lateral surface 31 or 33.

Figure 16:
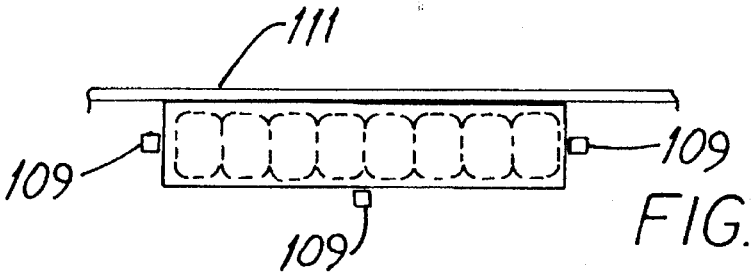
FIG. 16 is a representative plan view of still another embodiment of the terminal block shown in conjunction with a portion of an appliance enclosure wall. Parts are broken away and other parts are in dashed outline.
Figure 14:
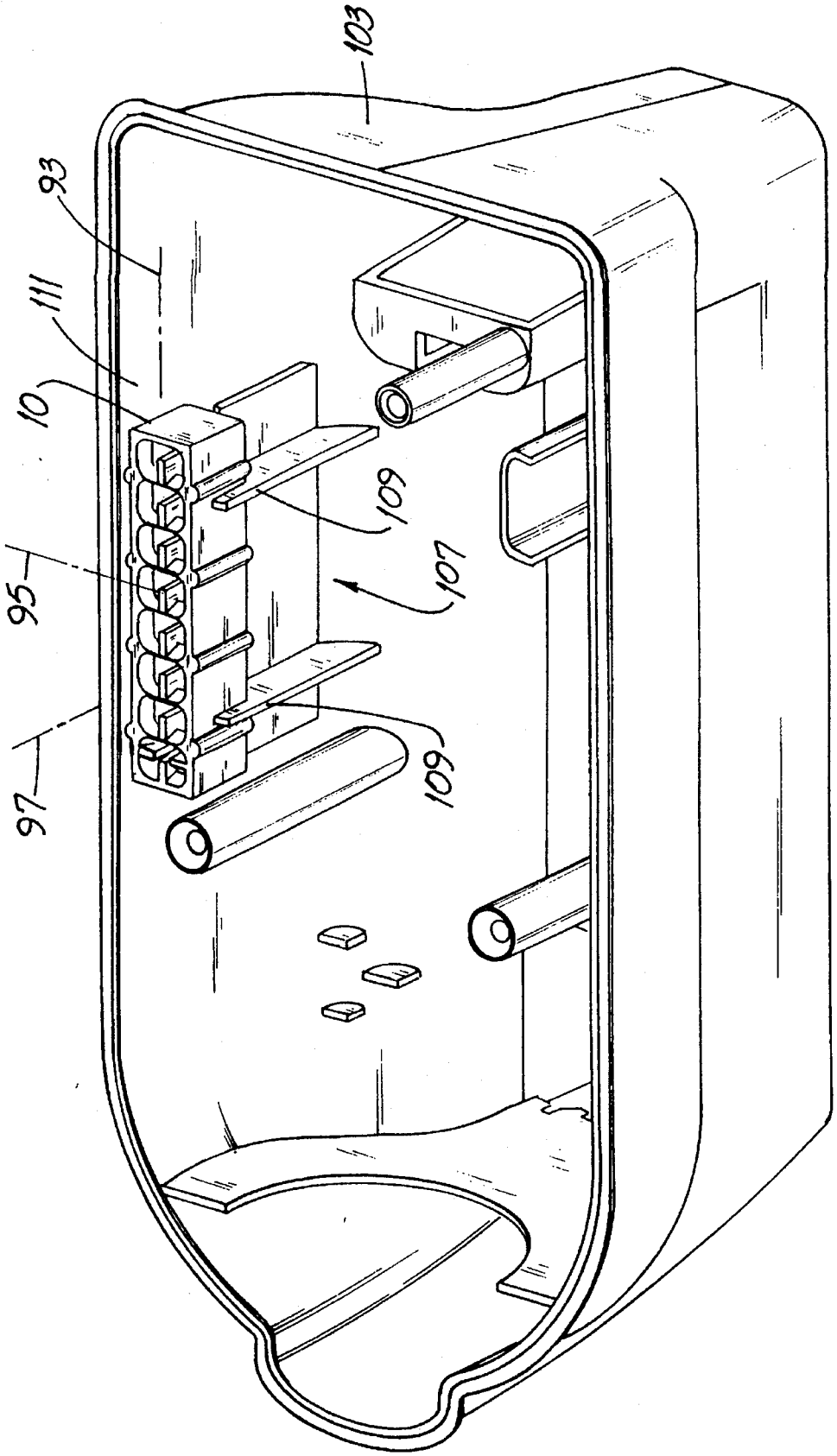
FIG. 14 is a perspective view of the terminal block housing in combination with a component of an exemplary small appliance housing.
Figure 15:
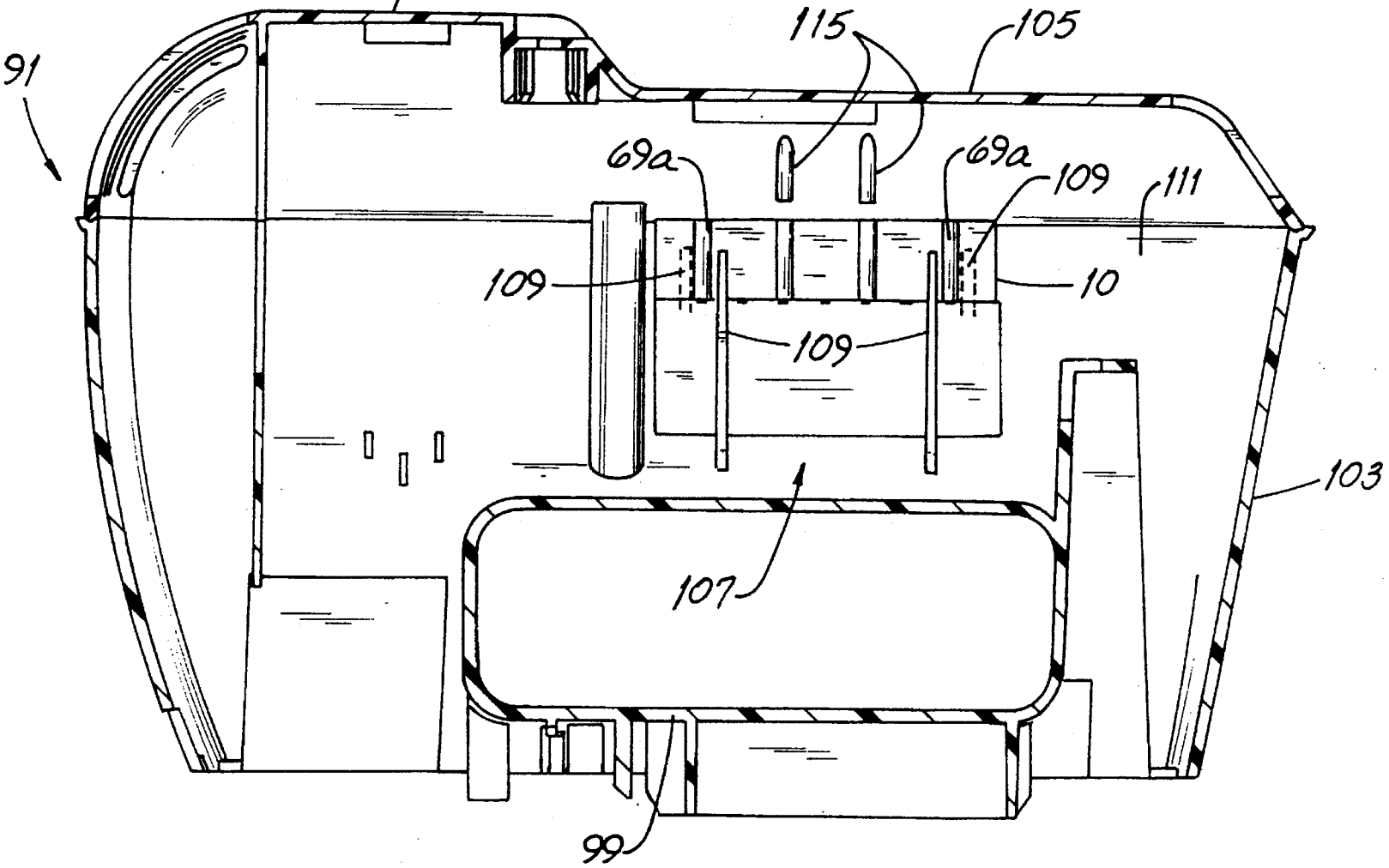
FIG. 15 is a side elevation view of the terminal block in combination with two components of an exemplary small appliance housing.

Referring additionally to FIGS. 14, 15 and 16, in another aspect of the invention, the terminal block 10 is combined with an appliance enclosure 91. Such combination incorporates unique features for restraining the block 10 against movement, both during and after assembly. More specifically, the block 10 is restrained from movement in any of three axes, e.g., a first long axis 93, a second lateral axis 95 and a third axis 97. The axes 93, 95 and 97 are orthogonal and further details of the arrangement are discussed below.

The exemplary enclosure 91 (which is depicted in FIG. 15 in an inverted position) is for a multi-speed mixer grasped by the handle 99 when in use. The mixer beaters (not shown) protrude upward at the location 101.

The enclosure 91 has first and second shell-like components 101, 103, respectively, which are attached to one another directly or by an intervening member (not shown). The first component 101 includes a platform 107 supporting the terminal block 10. Such platform 107 has a pair of finger-like block retention studs 109 and the terminal block **10*h* as a pair of surface deformations 69 embodied as outwardly-projecting ridges 69*a*. In the version shown in solid outline, the ridges 69*a* lie outside the studs 109. But, of course, the ridges 69*a* and studs 109 may be arranged so that the studs 109 lie outside the ridges 69*a*** as shown in dashed outline.

Figure 8:
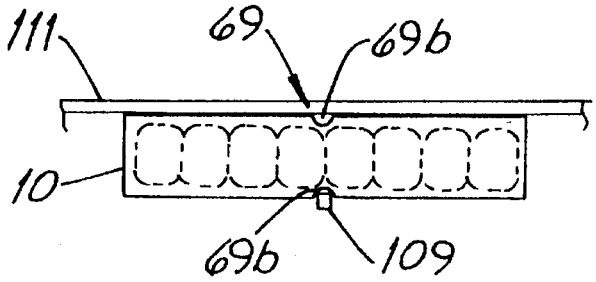
FIG. 8 is a representative plan view of one embodiment of the terminal block shown in conjunction with a portion of an appliance enclosure wall. Parts are broken away and other parts are in dashed outline.
Figure 10:
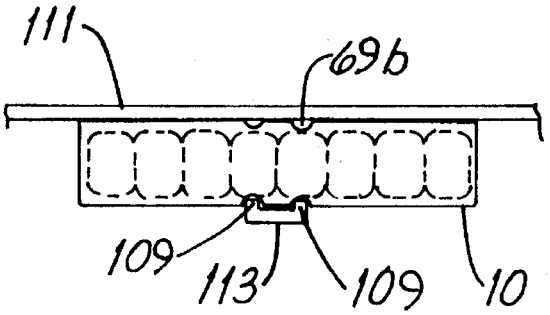
FIG. 10 is a representative plan view of yet another embodiment of the terminal block shown in conjunction with a portion of an appliance enclosure wall. Parts are broken away and other parts are in dashed outline.

In the embodiment shown in FIG. 8, the platform 107 has at least one finger-like block retention stud 109 engaging a surface deformation 69 embodied as a depression **69*b*. As with the arrangement of FIG. 14, the block 10 is thus "captured" between the wall 111 of the component 103 and the stud 109 and is restrained from movement along both the first axis 93 and the second axis 95. Yet another arrangement is shown in FIG. 10 and includes a pair of studs 109 formed as a single piece. Each stud 109 engages a depression 69*b***.

Figure 9:
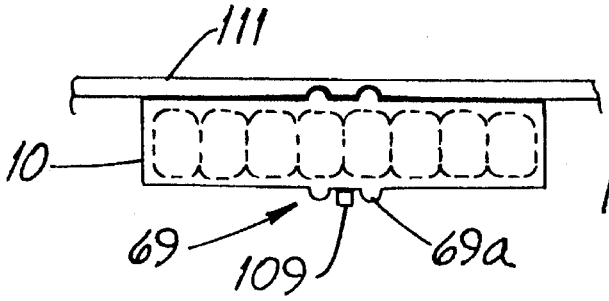
FIG. 9 is a representative plan view of another embodiment of the terminal block shown in conjunction with a portion of an appliance enclosure wall. Parts are broken away and other parts are in dashed outline.

As shown in FIG. 9, similar motion restraint is provided where the surface deformation 69 is embodied as a pair of ridges **69*a* with the stud 109 fitted between such ridges 69*a*. Yet another arrangement is shown in FIG. 16 in which the block 10 has no surface deformations 69. Rather, there are plural retention studs 109 limiting movement of the block 10 in either of the axes 93, 95**.

And that is not all. As best seen in FIG. 15, the second component 105 has at least one retention tang 115. When the appliance is assembled, the terminal block 10 is also captured between the platform 107 and the retention tang 115. This restrains block movement toward or away from the platform 107, i.e., in a direction along the third axis 97.

Other aspects of the utility of the new terminal block 10 will be further appreciated from a consideration of FIGS. 3B and 3C. A wire 65 is inserted into the V-shaped slot 87 defined by the flat upper finger 77 and the J-shaped lower finger 83 of each wire-grasping structure 43. Appreciating the fact that the lower finger 83 slopes upward and away from the viewer, the wire 65 is visually guided into the structure 43 by such sloping finger 83, by the tongue 41 and by the flared mouth 59 for quick, secure attachment.

It is also apparent from FIG. 4 that after a connector 25 is urged rearward out of the housing 11 using a small screwdriver or similar instrument, the wire 65 is readily detached from the connector 25. Such detachment is by moving the wire 65 laterally as indicated by the arrow 117.

Each connector 25 of the new terminal block 10 is intended to connect only two wires 65 together. However, three or more wires 65 can be connected to one another by using jumpers inserted into a structure 43 of each of three or more connectors 25.

While the principles of the invention have been described in connection with a few specific embodiments, it is to be clearly understood that such embodiments are by way of example and are not limiting.

I claim:

1. In a terminal block having an insulating housing holding a plurality of electrically-conductive connectors, the improvement wherein:

at least a first connector is bifurcated to define a pair of wire-grasping structures;

the structures are separated by a tongue-like barrier;

the first connector includes first and second arms, each having a pair of spaced fingers; and, each finger of the first arm coacts with a finger of the second arm to provide one of said wire-grasping structures.

2. In a terminal block having an insulating housing holding a plurality of electrically-conductive connectors, the improvement wherein:

at least a first connector is bifurcated to define a pair of wire-grasping structures;

the structures are separated by a tongue-like barrier;

the housing includes an aperture and the first connector is held in the aperture;

the aperture has a flared mouth portion; and, the mouth portion and the barrier define a guide visually aiding insertion of a wire into a wire-grasping structure.

3. The terminal block of claim 1 wherein the housing includes a retention surface and the first connector includes a retention tab bearing against the surface for retaining the connector in the housing.

4. The terminal block of claim 3 wherein the tab extend from between the fingers of the second arm.

5. The terminal block of claim 1 wherein:

first connector has a rear panel; and, rear panel includes a hole for engaging a locating pin when the block is mounted.

6. The terminal block of claim 1 wherein the barrier comprises an insulating tongue interposed between the wire-grasping structures whereby a wire grasped at two points by a pair of fingers is restrained from lateral wire-detaching movement.

7. The terminal block of claim 6 wherein:

the housing has a plurality of apertures, each for receiving a connector;

each aperture is bounded by a first surface and a second surface;

the tongue has a first edge spaced from the second surface; and, the connector is received in the space.

8. The terminal block of claim 7 wherein at least one aperture has a rear opening and the tongue has a second edge spaced from such rear opening.

9. The terminal block of claim 1 wherein:

the housing includes an aperture and the first connector is held in the aperture;

the aperture has a flared mouth portion; and, the mouth portion and the barrier define a guide visually aiding insertion of a wire into a wire-grasping structure.

10. The terminal block of claim 1 wherein:

at least the first connector is held in an aperture;

the aperture is bounded by a first surface and a second surface; and, the second surface has a groove facilitating insertion of the first connector into the aperture.

11. The terminal block of claim 1 wherein:

the housing has a plurality of apertures, each for receiving a connector;

the tongue-like barrier has an edge limiting movement of a connector into such aperture.

12. The terminal block of claim 1 including:

a wire connected to a first wire-grasping structure;

a rib projecting across the first wire-grasping structure for preventing damage to such first wire-grasping structure by improper pulling of the wire.

13. The terminal block of claim 12 wherein each wire-grasping structure has a rib projecting thereacross.

14. In a terminal block having an insulating housing holding a plurality of electrically-conductive connectors, the improvement wherein:

at least a first connector is bifurcated to define first and second wire-grasping structures;

the structures are separated by a tongue-like barrier;

a wire is connected to the first wire-grasping structure; and a rib projects across the first wire-grasping structure for preventing damage to such first wire-grasping structure by improper pulling of the wire.

15. The terminal block of claim 14 wherein each wire-grasping structure has a rib projecting thereacross.

* * * * *